United States Patent [19]

Convey, Jr.

[11] Patent Number: 4,691,502

[45] Date of Patent: Sep. 8, 1987

[54] APPARATUS FOR PLACING A CARD ON A BUNDLE OF SHEET-LIKE ARTICLES

[75] Inventor: Frank H. Convey, Jr., Peru, N.Y.

[73] Assignee: Harris Graphics Corporation, Melbourne, Fla.

[21] Appl. No.: 896,721

[22] Filed: Aug. 15, 1986

[51] Int. Cl.[4] ..... B65B 13/20; B65B 61/20

[52] U.S. Cl. ..... 53/529; 53/128; 53/156; 53/157; 53/589

[58] Field of Search ..... 53/399, 415, 445, 436, 53/528, 589, 580, 128, 137, 156, 157, 529

[56] References Cited

U.S. PATENT DOCUMENTS

| | | | |
|---|---|---|---|
| 3,169,471 | 2/1965 | McLean | 53/128 X |
| 3,241,287 | 3/1966 | Chundelak | 53/128 |
| 3,824,758 | 7/1974 | Hart | 53/436 X |
| 4,318,264 | 3/1982 | Rewitzer | 53/528 X |
| 4,554,867 | 11/1985 | Thumm | 53/528 X |

*Primary Examiner*—John Sipos

*Attorney, Agent, or Firm*—Tarolli, Sundheim & Covell

[57] ABSTRACT

An apparatus for placing a card on a bundle of sheet-like articles comprises a support for supporting the card adjacent the bundle, a feed device for feeding the card into the support, and a mechanism for placing a strap around the bundle, the card being stripped from the support by relative movement between the bundle with the card attached thereto and the support.

5 Claims, 4 Drawing Figures

APPARATUS FOR PLACING A CARD ON A BUNDLE OF SHEET-LIKE ARTICLES

BACKGROUND AND SUMMARY OF THE PRESENT INVENTION

The present invention relates to an apparatus for placing a card or the like into a bundle of sheet-like articles, such as newspapers.

A conventional apparatus for tying a bundle of newspapers is shown in U.S. Pat. application Ser. No. 749,561, assigned to the assignee of the present invention. The apparatus includes a conveyor which receives signatures, such as newspapers, in a lapped stream. The lapped stream of newspapers is formed into a stack by a stacker mechanism. A shuttle assembly sequentially moves loose stacks of newspapers from a central stacking station to either right or left tying stations. The loose stacks of newspapers are bound or tied at the tying stations by tying or strapping machines. The bound or tied stacks of newspapers are then delivered from the machine. A tying machine generally comprises a tying mechanism for placing a strap around the bundle. The tying machine may include a compression means that engages the top surface of the bundle and compresses the same before the strap is placed around the bundle. The compression means comprises two pressure blocks arranged on opposite sides of the tying mechanism chute that guides the strap or the like around the bundle. The tying machine also comprises two fluid cylinder for moving the pressure blocks from a retracted position to engage the top of the bundle.

An identification card may be placed on the bundle. An identification card may identify the number of newspapers in the bundle, the address and/or person to receive the bundle, etc. At present, the identification card is placed on the bundle manually. Manual placement of the identification card on the bundle is cumbersome.

In accordance with the present invention, an identification card is placed on a bundle when the bundle is tied. The card is fed into position adjacent the bundle by a card feeding means and then is attached to the bundle when a strap is placed around the bundle. The card feeding means generally comprises a cage mounted adjacent to the tying mechanism in a substantially vertical plane and having a lower end portion extending in a substantially horizontal plane. The cage defines a path into which the identification cards are placed and has an exit mouth in the horizontal portion thereof through which the identification cards are delivered.

The cage is mounted in such a manner that the exit mouth aligns with slots in the two pressure blocks when the pressure blocks are in the retracted position. Thus, the slots in the pressure blocks receive an identification card when the pressure blocks are in the retracted position. The slots in the pressure blocks extend in a direction which is substantially parallel to the top of the bundles. A through slot is provided in the pressure block which is located adjacent to the exit mouth of the cage and a slot with a bottom is located in the more remote pressure block. The card feed means further includes drive means for delivering an identification card tnrough the exit mouth into the slots in the pressure blocks in timed relationship with operation of the latter.

When the pressure blocks are moved into engagement with the top of the bundle, the card is located in the slots and adjacent to the top of the bundle. Then, the tying mechanism is operated to place a strap around the bundle. The strap overlies the card and strips the card from the pressure blocks when it contracts, attaching the card to the bundle as the bundle is tied.

BRIEF DESCRIPTION OF THE DRAWINGS

Numerous advantages and features of the present invention will become fully apparent to one skilled in the art from the followinq description of a preferred embodiment of the present invention and from the accompanying drawings wherein.

DESCRIPTION OF THE PREFERRED EMBODIMENT

Figure 1:
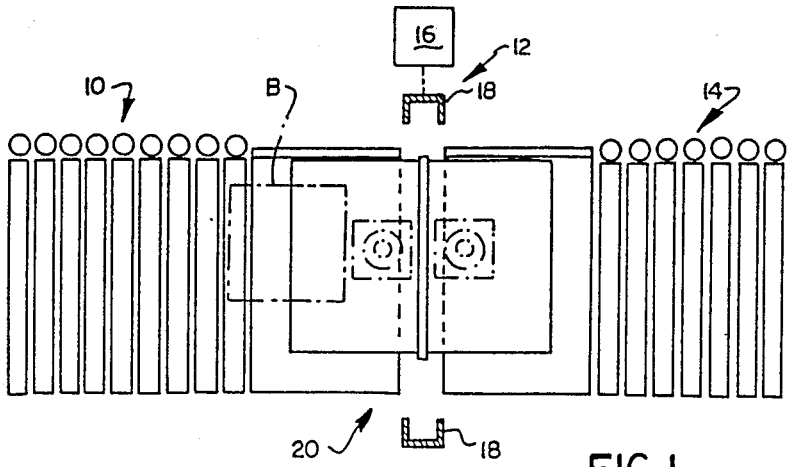
FIG. 1 is a schematic top view of an apparatus embodying the present invention.

As seen in FIG. 1, stacks B of signatures, i.e., newspapers, are moved by an input conveyor 10 to a tying machine 12. The tying machine places a strap around the stacks of newspapers. Then, the bundles are transported by an output conveyor 14. The tying machine 12 includes a strap feed mechanism 16 which moves a strap or band along a chute 18 which extends around a tying station 20. The chute 16 is formed by a generally U-shaped track. The chute 18 opens inwardly toward the space enclosed thereby. Although the tying machine 12 may have many different constructions, the tying machine 12 preferably is a Series MCD-710 Automatic Power Strapping Maching obtained from Signode Corporation of 2600 N. Western Ave., Chicago, Illinois, U.S.A.

The apparatus according to the present invention includes two compression blocks 22 and 24 for compressing a bundle arriving at the tying station. Two fluid cylinders 26 and 28 effect movement of the compression blocks 22 and 24 between a retracted position and a position compressing the stack in a known manner. The compression block 22 has a through slot 30. The slot 30 has diverging openings 32 and 34 at the opposite ends thereof. The compression block 24 has a slot 36 having a divergent opening 38 and a tapered end surface 40. When a card is introduced into the slot 36, its lead edge engages the surface 40 which decelerates the card as it rides up surface 40 and bounce back of the card. The surface 40 is inclined at an angle of approximately 45° .

Figure 2:
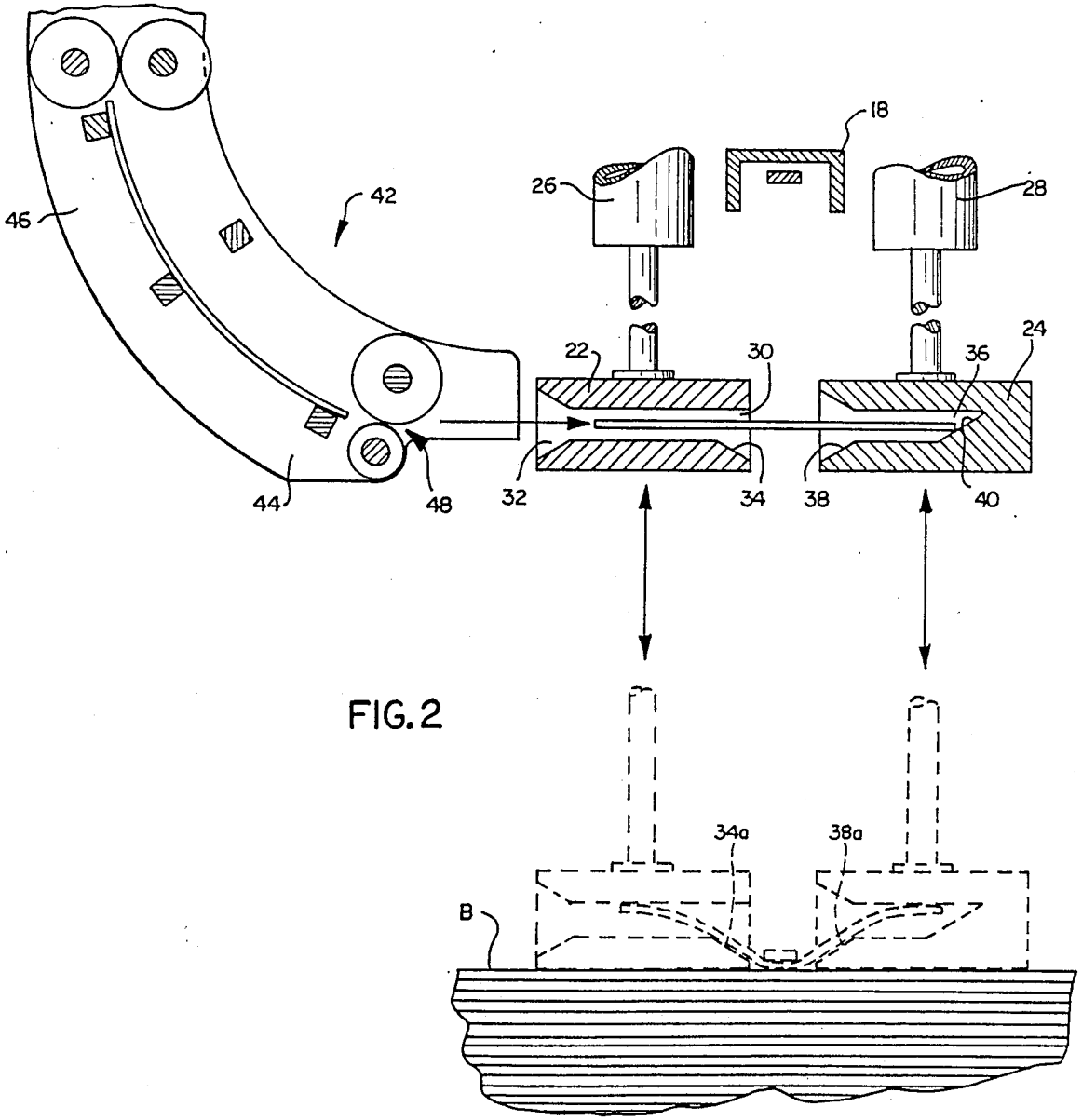
FIG. 2 is a schematic illustration depicting placement of an identification card in a bundle.

The identification card feed means 42 of the present invention is mounted adjacent the pressure block 22. In FIG. 2, only the lower portion 44 of the caqe 46 of the card feed means 42 is shown. The cage 46 is mounted such that card exit mouth 48 thereof is located in alignment with and adjacent the inlet opening 32 of the slot 30 in the pressure block 22 when the pressure blocks are in their retracted position.

Figure 3:
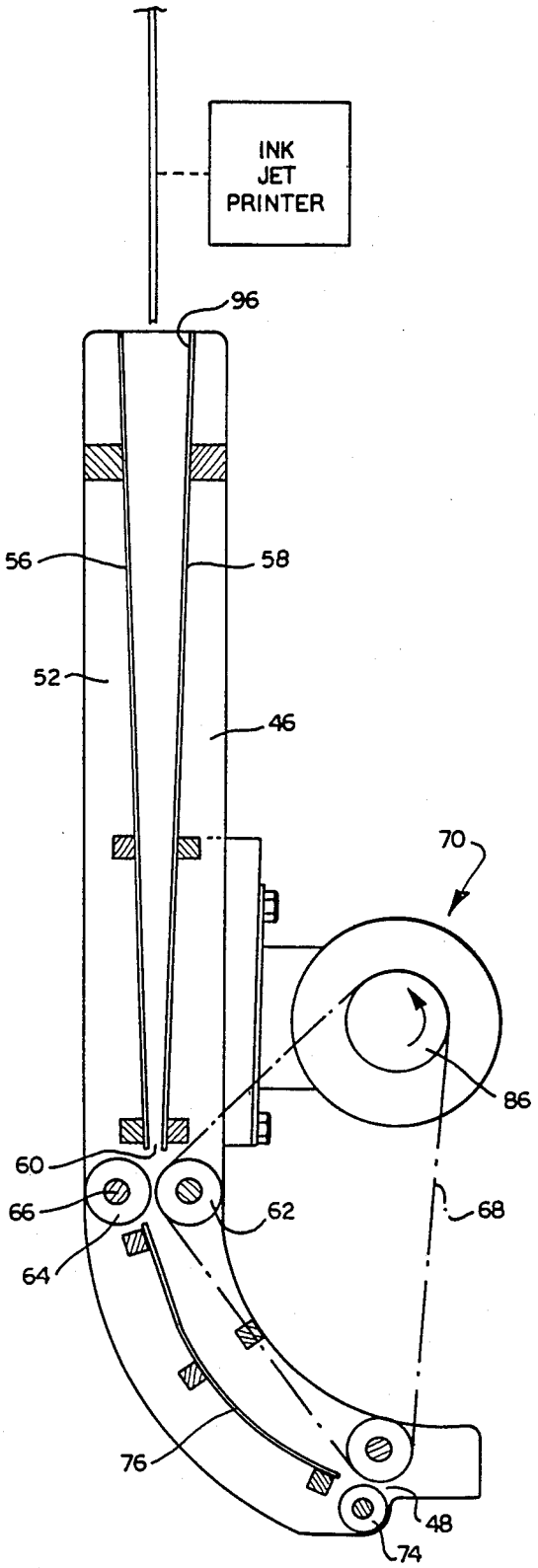
FIG. 3 is an elevational view showing the card feed means embodied in the present invention.
Figure 4:
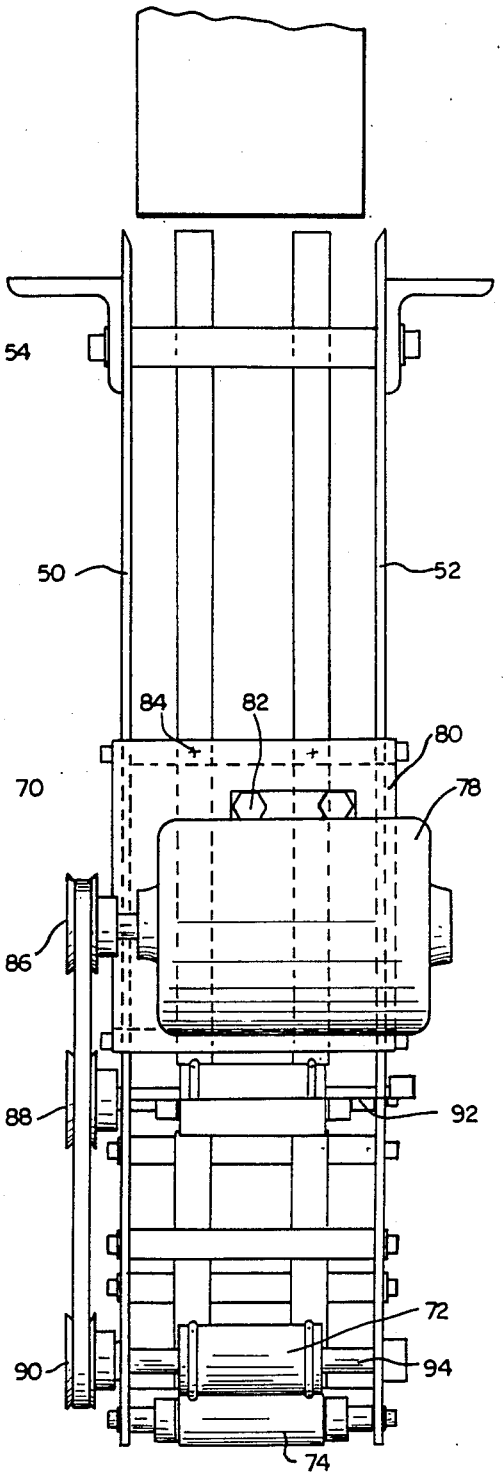
FIG. 4 is a side view of the card feed means of FIG. 3.

The card feed means 42 comprises two side plates 50, 52 (see FIG. 4) connected by a plurality of transverse supports 54, thus defining a frame. The cage 46 mounted on the frame includes two plate guides 56 and 58 extending vertically (see FIG. 3). The length of the guide plates 56 and 58 is substantially equal to the length of the vertical portion of the cage 46. The guide plates 56 and 58 converge toward each other so as to define a narrow opening 60 at the lower ends thereof. Immediately beneath the opening 60, there is mounted a first pair of guide rollers 62 and 64. The roller 64 is mounted for rotation about the axis of a stub shaft 66 fixed in the frame. The other roller 62 is driven by a timing belt 68 of a drive mechanism 70. The exit mouth 48 is defined by a second pair of guide rollers 72 and 74. The roller 72 is driven by the timing belt 68. The roller 74 is an idle roller. A curved guide plate 76 guides the cards between the rollers 62, 64 and 72, 74.

The drive mechanism 70 includes an electric motor 78. The motor 78 is mounted on a mounting plate 80 by screw means 82. The mounting plate 80 is attached to the cage 46 by fastener means 84. A driving pulleY 86 is mounted on the output shaft of the electric motor 78 for driving the timing belt 68. Driven pulleys 88 and 90 are fixedly mounted on shafts 92 and 94 which support the rollers 62, 72 and are supported for rotation in side plates 50 and 52.

The entrance 96 of the cage 46 defined by the upper diverging ends of plate guides 56 and 58 communicates with a supply of cards not shown. As the cards move from the supply to the entrance 96, they pass an ink jet printer. ink jet printer prints suitable information on the cards under computer control, as is known.

The operation of the drive means 70 and the fluid cylinders 26 and 28 are synchronized in such a manner that the timing belt 68 advances an identification card throuqh exit mouth 48 when the pressure blocks 22 and 24 are moved to their retracted position in which the inlet opening 32 of the slot 30 is located in alignment with the exit mouth 48 of the card feed means. This places a card in the pressure blocks 22, 24. Then, the pressure blocks 22 and 24 are moved by fluid cylinders 26, 28 into engagement with the top surface of a bundle B advanced to the tying station 20. In this position of the pressure blocks 22 and 24, the identification card is located in close proximity to the top surface of the bundle. When the tying mechanism 16 subsequently places a strap or the like around the bundle, the identification card is clamped to the bundle, as shown in the lower portion of FIG. 2. The card as shown becomes somewhat bent. As the pressure blocks 22, 24 return from engagement with the bundle to their retracted position, the card (clamped to the bundle by the strap) cannot follow. Thus, the ends of the card are stripped from the slots 30, 36 and becomes attached to the bundle. As shown in lower portion of FIG. 2, the inclined surfaces 34*a*, 38*a* of openings 34 and 38 permit easy stripping of the card from the pressure blocks 22 and 24.

While the invention has been described herein in terms of the preferred embodiment, numerous variations may be made in the apparatus illustrated in the attached drawinqs and herein described without departing from the spirit and scope of the invention as set forth in the appended claims.

I claim:

1. An apparatus for placing a card on a bundle of sheet-like articles at a typing station where the bundle is tied, said apparatus comprising:

support means for supporting the card adjacent the bundle at the tying station, said support means comprising two spaced pressure blocks for compressing the bundle, said two pressure blocks being movable between an engaged position in which a surface on each block engages the top surface of the bundle for compressing the bundle and a retracted position, each of said two pressure blocks comprising a slot space from said engaging surface, extending parallel to the top surface of the bundle and aligned with the slot in the other of said two pressure blocks for receiving the card, said slots supporting the card adjacent the top surface of the bundle when the respective engaging surfaces of said two pressure blocks engage the top surface of the bundle;

feed means for feeding the card into said aligned slots;

means for placing a strap around the bundle and the card while said surface on each block engages the top surface of the bundle and the bundle is compressed by said pressure blocks and the card is supported adjacent the top surface of the bundle and effecting engagement of the card with the top surface of the bundle to secure the card to the top surface of the bundle upon trying of the strap; and means for effecting relative movement of said support means and the bundle for stripping the card from said support means.

2. An apparatus as set forth in claim 1 wherein the slot in one of said two pressure blocks which is adjacent to said feed means is a through slot and the slot in the other of said two pressure blocks remote from said feed means has an end surface extending at an angle to the direction of movement of the card when the card is fed by said feed means.

3. An apparatus as set forth in claim 1, wherein said feed means comprises a cage defining guide means for advancing the cards into said slots, the cage having a substantially vertical portion the upper end of which defines an inlet for receiving the cards and a substantially horizontal end portion which defines an outlet for the cards.

4. An apparatus as set forth in claim 1, wherein said feed means has an outlet for the card aligned with said slots when said two pressure blocks are in their retracted position, and said feed means comprises a continuous belt for advancing a card into said slots when said two pressure blocks are located at their retracted position.

5. An apparatus as set forth in claim 4, wherein said apparatus further comprises an electric motor for moving said belt, the operation of said electric motor being synchronized with operation of fluid pressure means that effects movement of said two pressure blocks between their engaged and retracted positions.

* * * * *

UNITED STATES PATENT AND TRADEMARK OFFICE

CERTIFICATE OF CORRECTION

PATENT NO. : 4,691,502

DATED : September 8, 1987

INVENTOR(S) : Frank H. Convey, Jr.

It is certified that error appears in the above-identified patent and that said Letters Patent are hereby corrected as shown below:

Column 4, line 28 change "trying" to --tying--.

Signed and Sealed this

Ninth Day of February, 1988

*Attest:*

DONALD J. QUIGG

*Attesting Officer*

*Commissioner of Patents and Trademarks*